US007886371B2

(12) United States Patent
Chiang

(10) Patent No.: US 7,886,371 B2
(45) Date of Patent: Feb. 15, 2011

(54) SWIMMING GOGGLES

(76) Inventor: Herman Chiang, 11F-2, No. 634-9, Ching-Ping Rd., Chung-Ho City, Taipei Hsien (TW)

( * ) Notice: Subject to any disclaimer, the term of this patent is extended or adjusted under 35 U.S.C. 154(b) by 749 days.

(21) Appl. No.: 11/851,736

(22) Filed: Sep. 7, 2007

(65) Prior Publication Data

US 2009/0038060 A1 Feb. 12, 2009

(30) Foreign Application Priority Data

Aug. 7, 2007 (TW) ..... 96212995 U

(51) Int. Cl.
*A61F 9/02* (2006.01)

(52) U.S. Cl. ..... 2/428; 2/442

(58) Field of Classification Search ..... 2/426, 2/428, 442

See application file for complete search history.

(56) References Cited

U.S. PATENT DOCUMENTS 4,021,862 A * 5/1977 Glasser et al. ..... 2/431
5,915,541 A * 6/1999 Beltrani ..... 2/430
6,405,384 B1 * 6/2002 Chiang ..... 2/428
6,804,835 B2 * 10/2004 Chou ..... 2/436
7,296,306 B2 * 11/2007 Chou ..... 2/448
2008/0111966 A1 * 5/2008 Chiang ..... 351/43

* cited by examiner

*Primary Examiner*—Katherine Moran
(74) *Attorney, Agent, or Firm*—Cheng-Ju Chiang

(57) ABSTRACT

Swimming goggles are provided including an outer frame and an inner frame integrally formed together, lenses respectively received in the outer frame, and a strap device with a head strap. The outer frame includes a first frame unitarily formed with hard material. The first frame defines receiving slots respectively for receiving the lenses. Each receiving slot has an inner edge with a first positioning portion formed thereon. The inner frame includes a second frame formed by soft material enveloping along the first frame, and defines openings respectively corresponding to the receiving slots. The lenses form second positioning portions along rims thereof for engaging with the first positioning portions. The strap device includes base portions respectively assembled on opposite sides of the first frame for supporting and adjusting the head strap. The strap device is only assembled to the first frame of the outer frame when being assembled.

13 Claims, 7 Drawing Sheets

SWIMMING GOGGLES

BACKGROUND OF THE INVENTION

1. Field of the Invention

The present invention relates to swimming goggles, and particularly, relates to integrative swimming goggles.

2. Related Art

In general, swimming goggles are divided into two types. The first type includes a left frame and a right frame, which are separate from each other and are connected by a connecting member. The second type includes a left frame and a right frame, which are integrated with a connecting member together. Regarding the second type, material of the left frame and the right frame is required to be hard enough for reliably fixing lenses on the left and the right frame and prevented deforming while being worn. Whereas it lead to a pad formed on a left frame and a right frame thereof is not soft enough, and therefore is not fine to touch face when swimming. Moreover, a connecting bridge between the left frame and the right frame, which is so stiff that can not meet various users with different face profiles. Additionally, the left frame and the right frame can not fit to users' faces, tending to leak.

SUMMARY OF THE INVENTION

Accordingly, an object of the present invention is to provide swimming goggles which are worn comfortably and prevent from water leakage.

The swimming goggles comprise an outer frame and an inner frame integrally formed together, lenses respectively received in the outer frame, and a strap device. The outer frame includes a first frame unitarily formed with hard material. The first frame defines receiving slots respectively for receiving the lenses. Each receiving slot has an inner edge with a first positioning portion formed thereon. The inner frame is integrally formed with the outer frame, and includes a second frame formed by soft material enveloping along the first frame. The second frame defines openings respectively corresponding to the receiving slots. The lenses form second positioning portions along rims thereof for engaging with the first positioning portions. The strap device includes a head strap assembled on opposite sides of the first frame. During assembly, the first positioning portions engage with the second positioning portions to preliminarily position the lenses. Sequentially the second frame enveloping the first frame and rims of the lenses by unitarily forming. Finally, the strap device is assembled to the first frame, whereby wearing and adjusting of the head strap does not influence the second frame.

Leakproof rings protrude along outward edges of the openings, and are integrally sealed along outward edges of lenses against water leakage.

DESCRIPTION OF THE PREFERRED EMBODIMENTS

Figure 1:
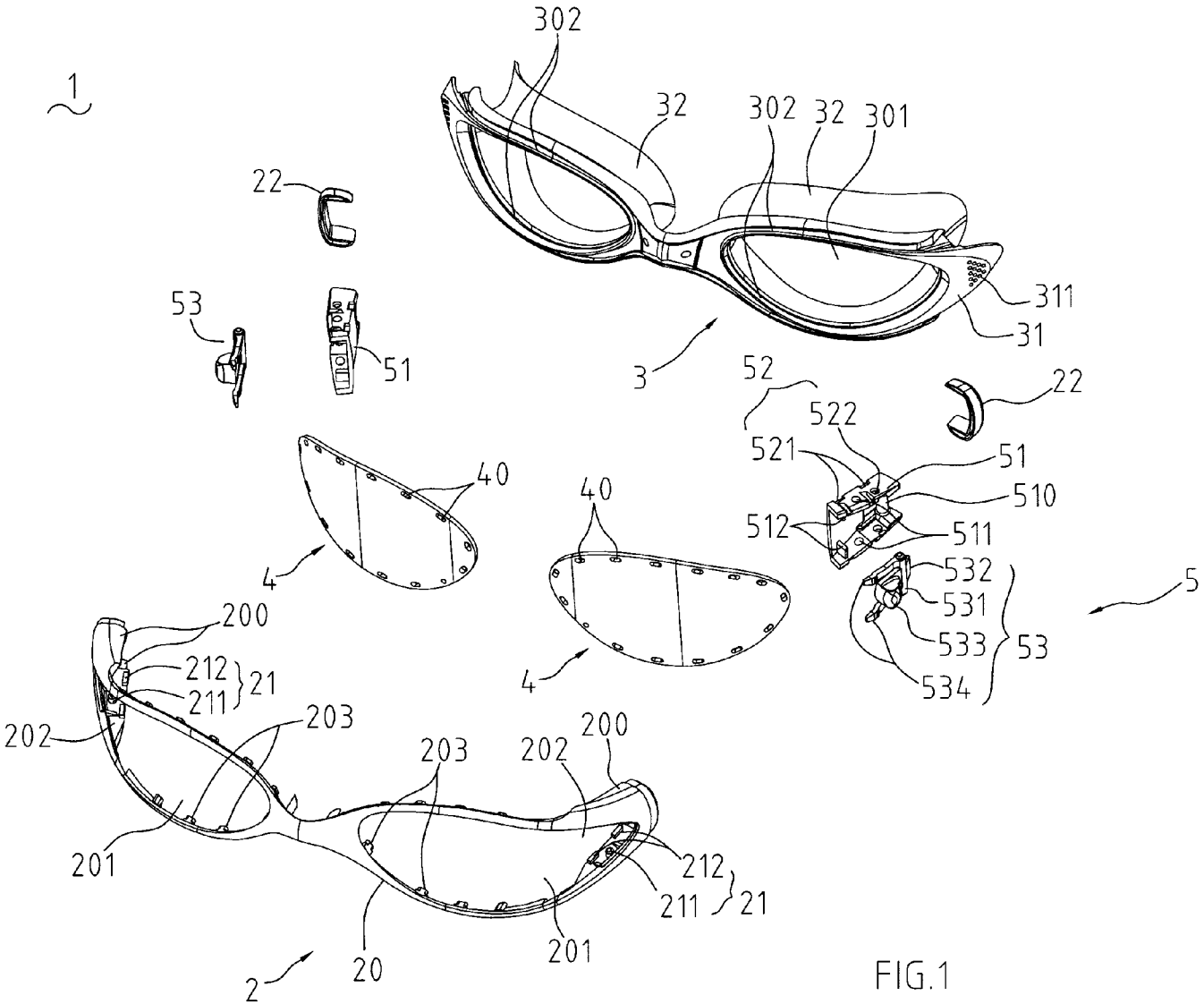
FIG. 1 is an exploded view of swimming goggles of the present invention.

With reference to FIG. 1, swimming goggles 1 of the present invention comprise an outer frame 2, an inner frame 3, lenses 4 and a strap device 5. The outer frame 2 and the inner frame 3 are integrally formed and together define a left frame, a right frame and a connecting bridge. The lenses 4 are respectively accommodated in the left frame and the right frame.

The outer frame 2 includes a laminated first frame 20 unitarily formed with hard material. In one embodiment, the hard material is PP. Side walls 200 are respectively formed on opposite sides of the first frame 20. First assembling portions 21 are respectively provided on the side walls 200. In one embodiment, each first assembling portion 21 comprises a fixing axis 211 and two buckles 212 for assembling the strap device 5. The first frame 20 defines receiving slots 201 respectively for mounting the lenses 4. The first frame 20 also defines expansion grooves 202 respectively at outward edges of the receiving slots 201 for assembling the strap device 5. Each receiving slot 201 has an inner edge with a first positioning portion 203 formed thereon. In one embodiment, the first positioning portion 203 comprises tabs 203 unitarily formed on the first frame 20. The first frame 20 further includes decorating frames 22 at opposite ends thereof.

The inner frame 3 includes a second frame 30 formed by soft material enveloping along the first frame 20. The soft material, for example, is Thermal Plastic Rubber (TRP) or silica gel, etc. The second frame 30 defines openings 301 corresponding to the receiving slots 201. Leakproof rings 302 protrude along outward edges of the openings 301, and are integrally sealed along outward edges of lenses 4 against water leakage. Enveloping layers 31 integrally extend from outward sides of the leakproof rings 302, and cover tops of the expansion grooves 202. Each enveloping layer 31 has a coarse surface 311. For instance, the coarse surface 311 consists of a plurality of granular arrayed in order for enhancing friction when being pressed. A pad 32 is integrally formed on outward sides of the openings 301.

The lenses 4 form second positioning portions 40 along rims thereof for engaging with the first positioning portions 203. In one embodiment, the second positioning portions 40 comprise through holes 40 for corresponding to the tabs 203. In assembly, the tabs 203 are assembled to the through holes 40 for retaining the lenses 4 inwardly, thus the lenses 4 are preliminarily positioned on the first positioning portions 203. The through holes 40 have profiles fitting to the tabs 203 and are oval.

Figure 4:
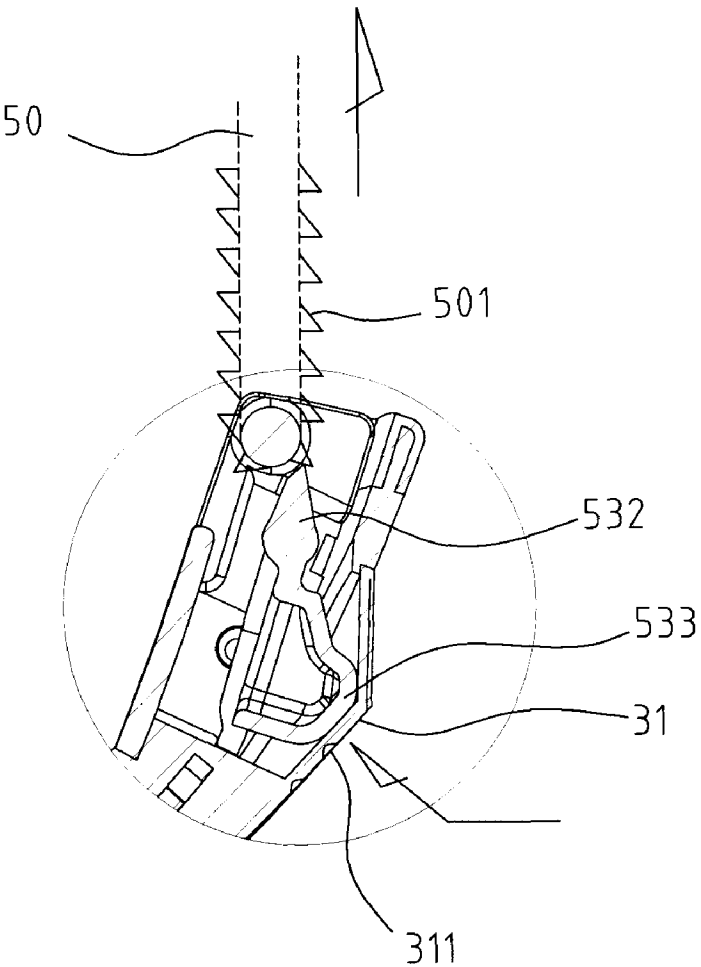
FIG. 4 is a partially enlarged view of the swimming goggles before adjusting a head strap thereof.

The strap device 5 comprises a head strap 50 (shown in FIGS. 4 and 5), and U-shaped base portions 51 respectively assembled on opposite sides of the first frame 20. The head strap 50 forms a plurality of abutting grooves 501. Each base portion 51 includes a positioning axis 510 for supporting the head strap 50, and support plates 512 corresponding to each other, and defines first axis holes 511 for corresponding to the fixing axes 211 of the first assembling portion 21. Each base portion further forms a second assembling portion 52 for assembling to the first assembling portion 21. In one embodiment, the second assembling portion 52 comprises locking grooves 521 for locking with the buckles 212 of the first assembling portion 21, and second axis holes 522 in the vicinity of the positioning axis 510.

Abutting members 53 are pivoted to the second axis holes 522 of the base portions 51. Each abutting member 53 forms an assembling axis 531 for assembling to the second axis holes 522. The abutting member 53 has an abutting edge 532 at an end thereof for abutting against the abutting grooves 501 of the head strap 50, and a button 533 at an opposite end thereof. The button 533 extends partly beyond the expansion groove 202. The enveloping layer 31 covers the button 533. The button 533 forms a pressing portion (not labeled) relatively projecting, and correspondingly, the enveloping layer 31 has a portion projecting for fitting to the pressing portion. Moreover, the coarse surface 311 of the enveloping layer 31 corresponds to the pressing portion for facilitating pressing. Resilient branches 534 respectively extend from opposite ends of the assembling axis 531 and bend toward the button 533. The branches 534 are mounted on the support plates 512. When the button 533 is pressed, the assembling axis 531 serving as a fulcrum, the abutting edge 532 moves in a reverse direction relative to the pressed direction, and the resilient branches 534 are compressed to deform and reserve energy for providing return force for the button 533.

Figure 2A:
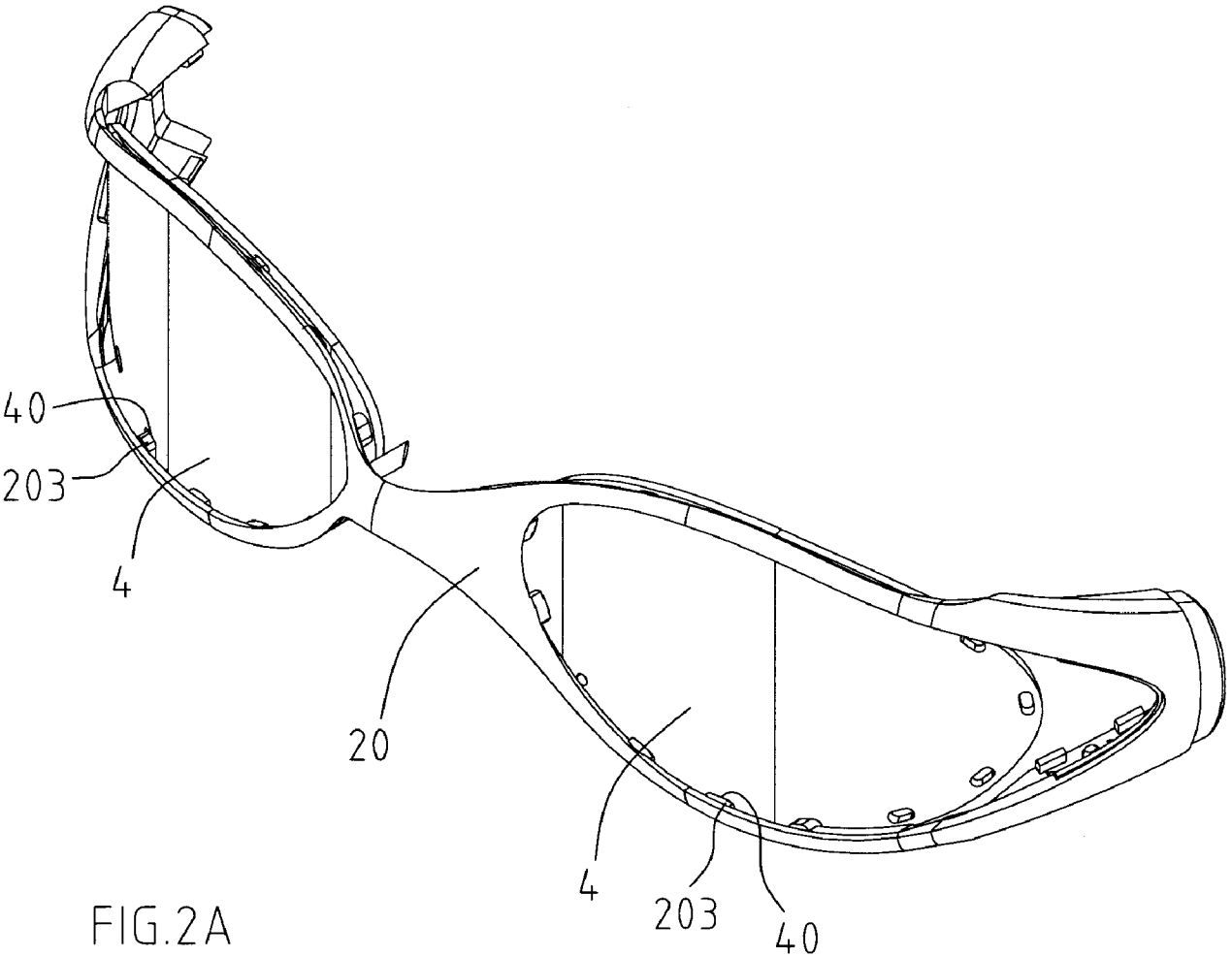
FIGS. 2A to 2C schematically show the swimming goggles of FIG. 1 being assembled stepwise.
Figure 2B:
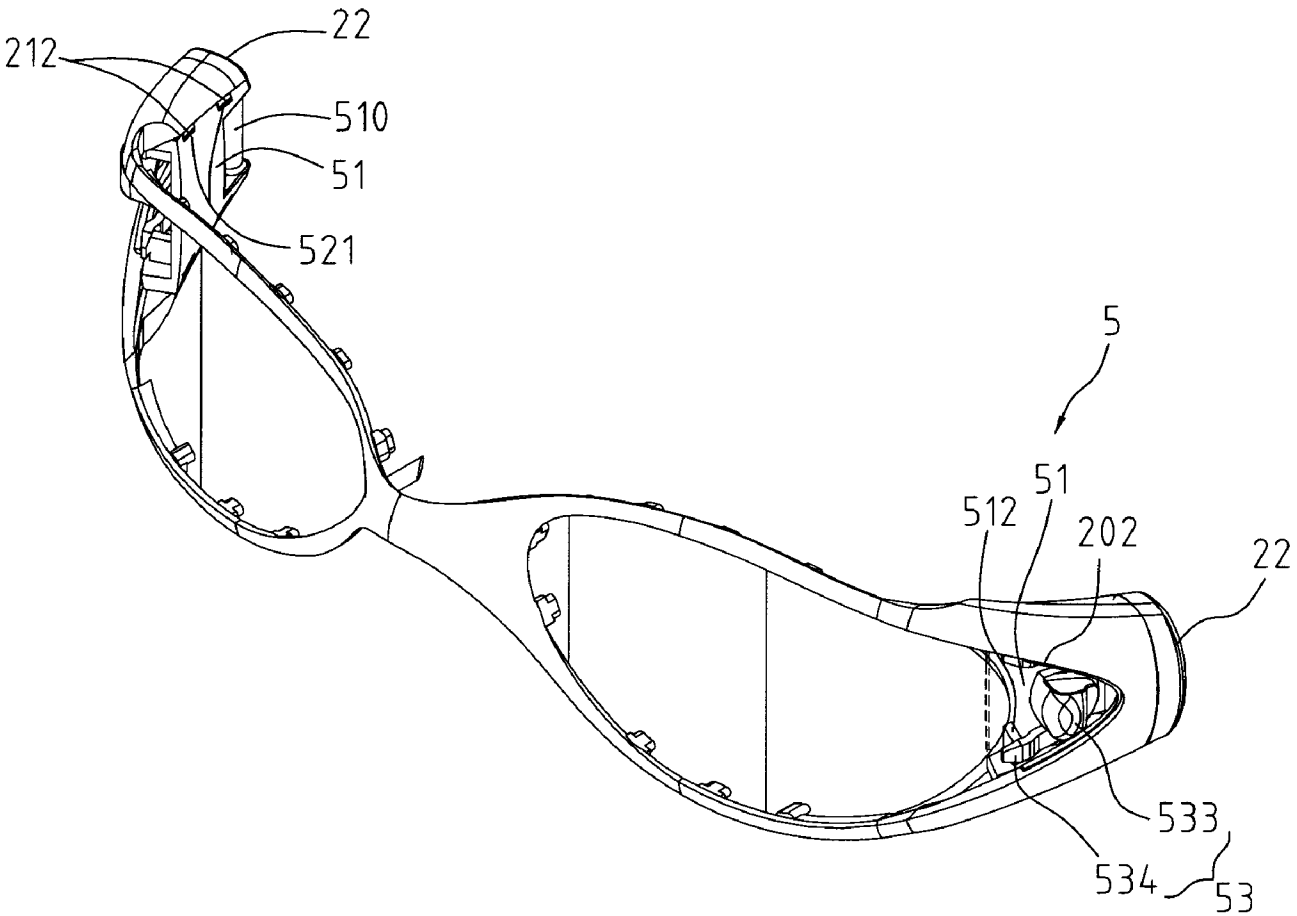
Figure 2C:
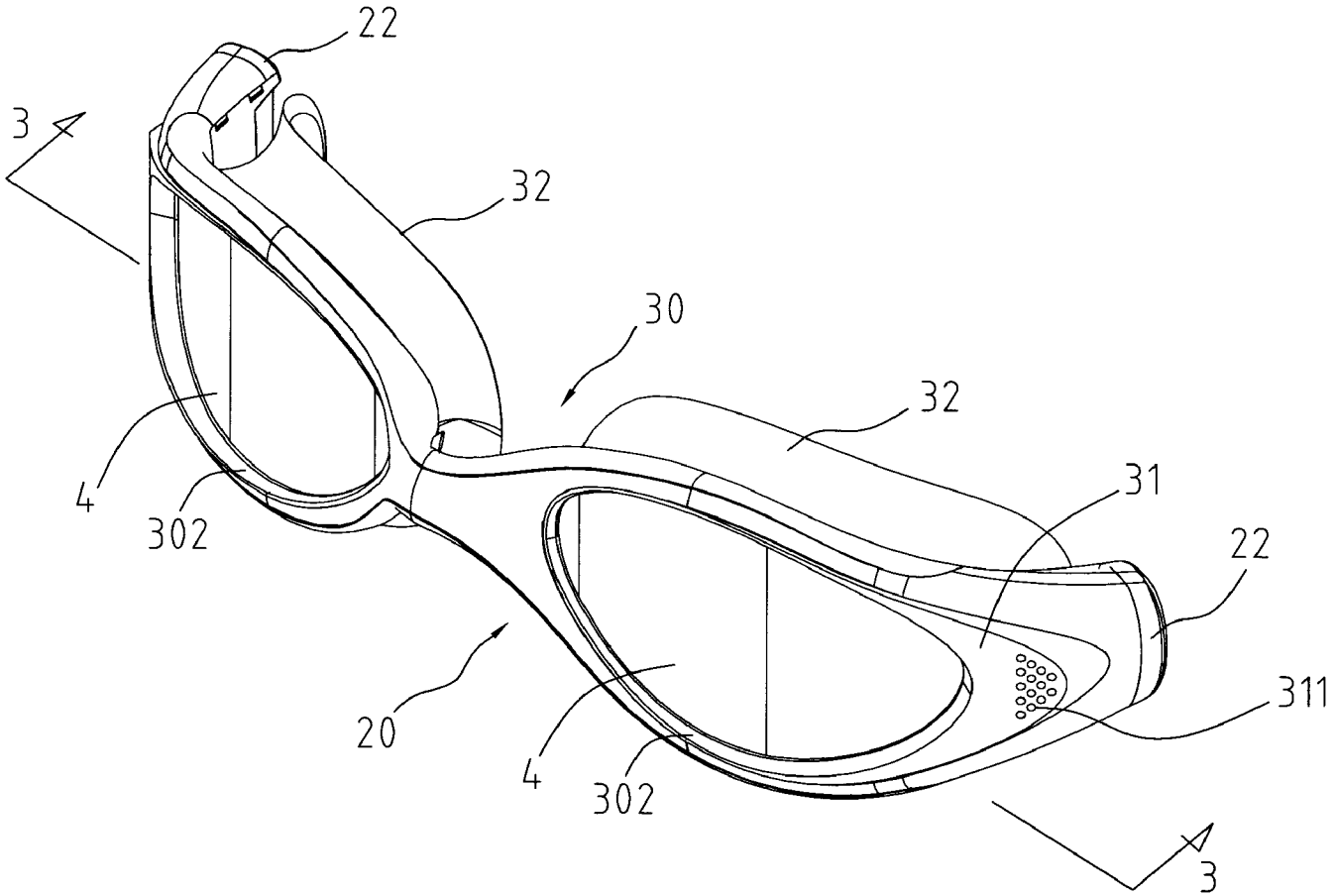
Figure 3:
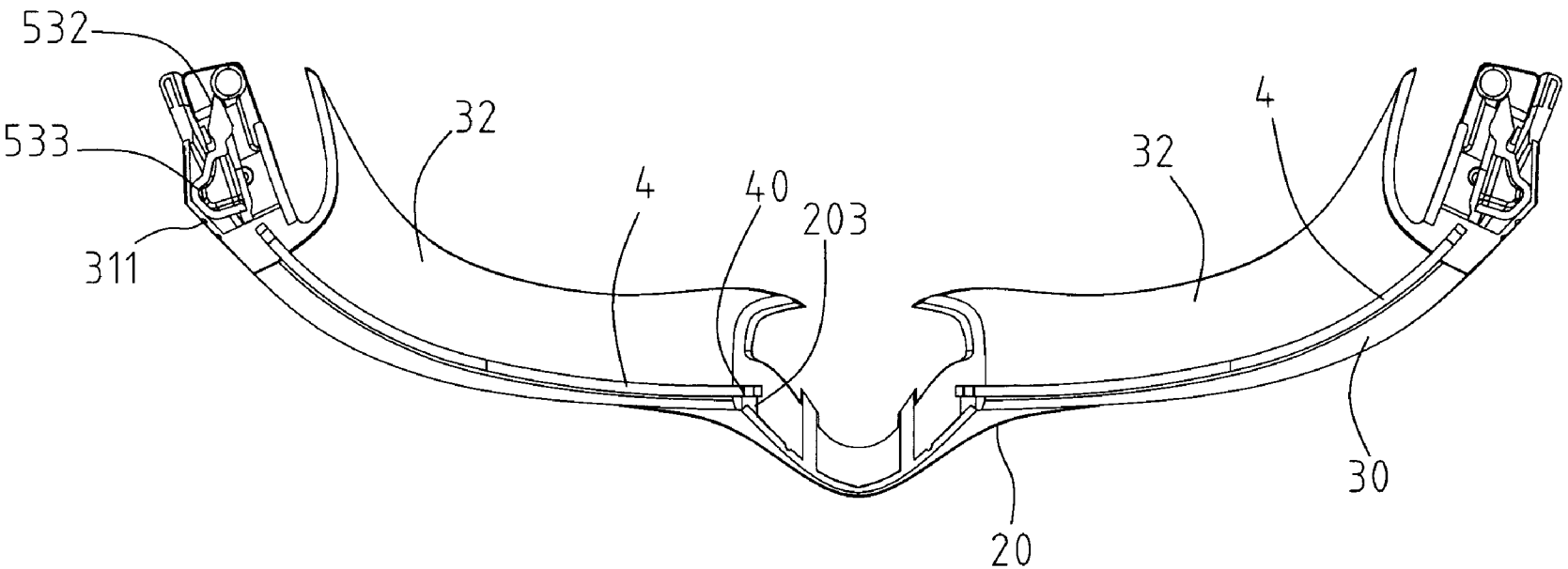
FIG. 3 is a sectional view of the swimming goggles taken along the line 3-3 of FIG. 2C.

FIGS. 2A to 2C illustrate assembly of the swimming goggles 1 step by step. Referring to FIG. 2A, the lenses 4 are retained to the first frame 20. The first positioning portions 203 of the first frame 20 are assembled to the second positioning portions 40 of the lenses 4. In one embodiment, the tabs 203 of the first frame 20 engage with the through holes 40 of the lenses 4. Thereafter, referring to FIG. 2C, the second frame 30 envelops the first frame 20 and rims of the lenses 4 by unitarily forming. Finally, the strap device 5 is assembled to the first frame 20. For explicitly interpreting assembly of the strap device 5, as shown in FIG. 2B, the second frame 30 is removed to show assembly of the base portions 51 and the abutting member 53 to the first assembling portion 21. The assembling axes 531 of the abutting members 53 are mounted on the second axis holes 522 of the base portion 51. The fixing axes 211 of the first frame 20 are mounted on the first axis holes 511 of the base portions 51. The locking grooves 521 of the second assembling portions 52 lock with the buckles 212 of the first frame 20. Thus, the base portions 51 and the abutting members 53 are fixed to the first frame 20. In assembly, the buttons 533 partly extend beyond the expansion grooves 202. The resilient branches 534 are mounted on the support plates 512. In the case the buttons 533 are pressed down, the resilient branches 534 deform to reserve energy. The decorating frames 22 are assembled on opposite sides of the first frame 20 before or after the assembly of the base portions 51 and the abutting members 53.

The head strap 50 is simply fastened to the first frame 20, and therefore, wearing and adjusting of the head strap does not influence the second frame 30. Consequently, the second frame 30 is allowed to be made of soft material for providing comfortable touching and fitting, and guarding against water leakage as well.

Figure 5:
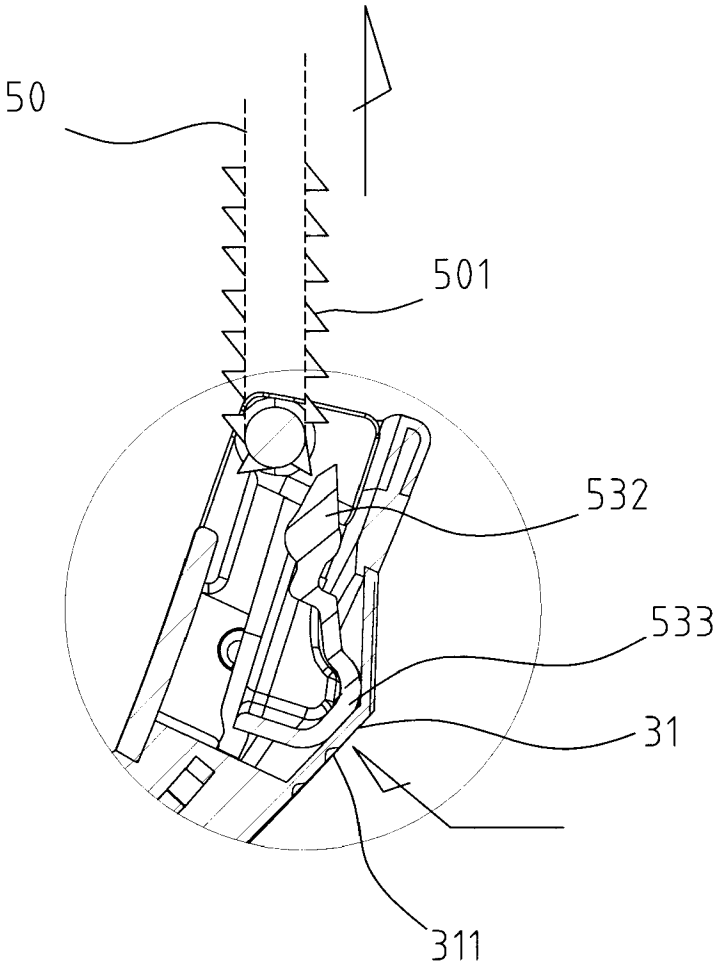
FIG. 5 is a partially enlarged view of the swimming goggles after adjusting a head strap thereof.

With reference to FIGS. 1, 3, 4 and 5, in normal state, the abutting edges 532 of the abutting members 53 stop the abutting groove 501 of the head strap 50. The head strap 50 is only allowed to tighten. As shown in FIG. 5, the button 533 is pressed in a direction as the arrow in FIG. 5. The assembling axis 531 of the abutting member 53 serves as a fulcrum, and the abutting edge 532 moves reverse to the pressed direction. Thus, the head strap is allowed to loosen. Meanwhile, the resilient branches 534 are pressed to deform and preserve energy for providing return force for the button 533. As the button 533 is released, the preserved energy of the resilient branches 534 urges the button 533 to return. By this means, the abutting member 53 assists in adjusting the head strap 50.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. Swimming goggles comprising:

an outer frame including a first frame formed with hard material and being laminated, the first frame defining receiving slots therein and further defining expansion grooves respectively at outward edges of the receiving slots, each receiving slot having an inner edge with a first positioning portion formed thereon, side walls being respectively formed on opposite sides of the first frame, first assembling portions being respectively provided on the side walls, each first assembling portion comprising a fixing axis and at least a buckle;

an inner frame integrally formed with the outer frame, and including a second frame formed by soft material enveloping along the first frame, the second frame defining openings respectively corresponding to the receiving slots, leakproof rings protruding along outward edges of the openings, and being integrally sealed along outward edges of lenses against water leakage;

lenses respectively received in the receiving slots of the outer frame, and each forming a second positioning portion along a rim thereof for engaging with the first positioning portion; and a strap device including a head strap assembled on opposite sides of the first frame, the strap device comprising U-shaped base portions respectively assembled on opposite sides of the first frame, the head strap forming a plurality of abutting grooves, each of the U-shaped base portions including a positioning axis for supporting the head strap, and defining first axis holes for corresponding to the fixing axes of the first assembling portion, and further forming a second assembling portion for being assembled to the first assembling portion;

wherein during assembly, the first positioning portions engage with the second positioning portions to preliminarily position the lenses, sequentially the second frame enveloping the first frame and rims of the lenses by forming, the strap device being assembled to the first frame, whereby wearing and adjusting of the head strap does not influence the second frame.

2. The swimming goggles as claimed in claim 1, wherein the second assembling portion comprises locking grooves for locking with the buckles of the first assembling portion.

3. The swimming goggles as claimed in claim 1, wherein each base portion further comprises second axis holes in the vicinity of the positioning axis, and wherein abutting members are respectively pivoted to the second axis holes of the base portions, each abutting member forming an assembling axis for assembling to the second axis holes, and each abutting member having an abutting edge at an end thereof for abutting against the abutting grooves of the head strap, and a button at an opposite end thereof, the button extending partly beyond the expansion groove, resilient branches respectively extending from opposite ends of the assembling axis and bending toward the button, when the button is pressed, the abutting edge moving in a reverse direction relative to the pressed direction of the button, and the resilient branches being compressed to deform and reserve energy for providing return force for the button.

4. The swimming goggles as claimed in claim 3, wherein enveloping layers integrally extend from outward sides of the leakproof rings, and cover tops of the expansion grooves.

5. The swimming goggles as claimed in claim 4, wherein the button forms a pressing portion relatively projecting, and the enveloping layer has a portion projecting for fitting to the pressing portion, thereby facilitating pressing.

6. The swimming goggles as claimed in claim 5, wherein each enveloping layer has a coarse surface in response to the pressing portion of the button.

7. The swimming goggles as claimed in claim 6, wherein the coarse surface of each enveloping layer consists of a plurality of granules arrayed in order.

8. The swimming goggles as claimed in claim 1, wherein the first frame further includes decorating frames at opposite ends thereof.

9. The swimming goggles as claimed in claim 1, wherein a pad is integrally formed on the second frame.

10. The swimming goggles as claimed in claim 9, wherein the pad integrally extends from outward sides of the openings.

11. The swimming goggles as claimed in claim 1, wherein the soft material of the second frame is Thermal Plastic Rubber (TRP) or silica gel, and wherein the hard material of the first frame is polypropylene (PP).

12. Swimming goggles, comprising:

an outer frame including a first frame formed with hard material, the first frame defining receiving slots therein, each receiving slot having an inner edge with a first positioning portion formed thereon, the first positioning portion comprising tabs integrally formed on the first frame;

an inner frame integrally formed with the outer frame, and including a second frame formed by soft material enveloping along the first frame, the second frame defining openings respectively corresponding to the receiving slots;

lenses respectively received in the receiving slots of the outer frame, and each forming a second positioning portion along a rim thereof for engaging with the first positioning portion, the second positioning portion comprising through holes for corresponding to the tabs, the tabs being assembled to the through holes for retaining the lenses inwardly; and a strap device including a head strap assembled on opposite sides of the first frame;

wherein during assembly, the first positioning portions engage with the second positioning portions to preliminarily position the lenses, sequentially the second frame enveloping the first frame and rims of the lenses by forming, the strap device being assembled to the first frame, whereby wearing and adjusting of the head strap does not influence the second frame.

13. The swimming goggles as claimed in claim 12, wherein the through holes are oval and have profiles fitting to the tabs.

* * * * *